United States Patent [19]

de Carteret

[11] 4,165,589

[45] Aug. 28, 1979

[54] REGLETS AND ASSOCIATED COMPONENTS

[76] Inventor: Arnold E. F. de Carteret, 16/21 Harrison St., Neutral Bay, NSW, Australia, 2089

[21] Appl. No.: 784,724

[22] Filed: Apr. 5, 1977

Related U.S. Application Data

[63] Continuation-in-part of Ser. No. 627,352, Oct. 30, 1975.

[51] Int. Cl.[2] ..... E04D 13/14; E04B 1/54

[52] U.S. Cl. ..... 52/61; 52/62

[58] Field of Search ..... 52/58–62, 52/98, 396, 403; 49/441, 440

[56] References Cited

U.S. PATENT DOCUMENTS

| | | | |
|---|---|---|---|
| 1,842,586 | 1/1932 | Davidson | 428/122 |
| 2,260,438 | 10/1941 | Cheney | 52/60 |
| 2,853,748 | 9/1958 | Kessler | 49/441 |
| 3,527,013 | 9/1970 | Kruschwitz | 428/83 |
| 3,793,795 | 2/1974 | Annand | 52/61 |
| 3,846,948 | 11/1974 | Dallen | 52/396 |
| 3,981,108 | 9/1976 | Berg | 52/98 |
| 4,055,921 | 11/1977 | de Carteret | 52/61 |

FOREIGN PATENT DOCUMENTS

| | | | |
|---|---|---|---|
| 1252603 | 12/1960 | France | 52/403 |
| 1456972 | 9/1966 | France | 52/62 |
| 569954 | 6/1945 | United Kingdom | 49/441 |

*Primary Examiner*—James L. Ridgill, Jr.

[57] ABSTRACT

This invention relates primarily to reglets and the associated components in a weatherproofing system for buildings in which the reglet comprises an elongate element including first and second walls connected to each other along adjacent longitudinal edges to form a channel, one wall of the channel is provided with an abutment surface, behind which an abutment face on a reglet wedge will lock to retain a flashing element, and a plurality of primary abutment surfaces behind which complementary abutments on a sealing portion of the wedge will lock to seal the mouth of the channel.

26 Claims, 24 Drawing Figures

REGLETS AND ASSOCIATED COMPONENTS

This is a continuation in part of an application, Ser. No. 627,352, filed Oct. 30, 1975 and entitled Reglets and Associated components.

BACKGROUND OF THE INVENTION

This invention relates to reglets and associated components in a weatherproofing system for buildings.

THE PRIOR ART

U.S. Pat. No. 2,260,438 by A Cheney dated Oct. 28, 1941 relates to weatherproofed building construction and discloses an elongate channel like structure adapted to be embedded into the wall of a building adjacent an area of the building to be protected against the weather. This element comprises a pair of spaced elongate walls connected to each other to form an elongate channel one wall of which has a series of grooves into which a bent portion of a flashing element is latched. The channel is disposed at an angle to a pair of longitudinal walls which are connected respectively to the free longitudinal edges of the first and second walls to provide fixing means for the element.

U.S. Pat. No. 3,793,795 by Annand dated Feb. 26, 1974 relates to a waterproofing receiver which comprises a channel shaped structure for embodiment in a building wall relative an area to be protected. One wall of this structure extends in the lateral direction of the building wall while the other wall diverges outwardly therefrom. A third wall extending from the floor or connecting web of the channel in the direction of the second wall functions with the second wall to form the flashing receiving part of the receiver. The flashing used with this device must have a return bent portion the free end of which is located in an inwardly facing channel extending along the free edge of the third wall. This third wall is then forced into engagement with the flashing by an element compressibly located in the channel area between the first and third walls of the receiver to urge the third wall against the flashing element.

French Pat. No. 1,456,972 by Scherling dated Sept. 29, 1965 discloses a reglet which comprises three longitudinally aligned parallel walls connected along adjacent longitudinal edges to a web forming a channel having a dividing wall extending therealong. One leg of an L shaped flashing element is located in one of the channel divisions and locked in place by an L shaped covering piece one leg of which is inserted in the other channel division.

U.S. Pat. No. 3,981,108 by Berg dated Sept. 21, 1976 discloses a reglet structure comprising an elongate channel having side walls which converge towards the mouth of the channel. A flashing element is located in this channel and retained therein by a mastic with which the channel is filled.

RELATED ART

U.S. Pat. No. 3,846,948 by Dallen dated Nov. 12, 1974 discloses a window glazing system. This system comprises a window frame the four sides of which, each comprise an elongate channel having flanges extending laterally outwards from the free longitudinal edges thereof and an upstanding wall at the free longitudinal edge thereof and which is embedded in a wall adjacent a window opening. A glass panel is then located in the frame in abutting relationship to the upstanding wall with a flexible element therebetween. The panel is retained in the frame by a sealing strip which is inserted into the channel.

U.S. Pat. No. 2,853,748 by Kessler dated Sept. 30, 1958 discloses a glazing strip formed in a flexible resilient material such as rubber or the like. This strip comprises an elongate channel the side walls of which have a longitudinal portion offset towards the longitudinal centreline of the channel. The free longitudinal edges of these offset portions are provided with flanges which extend transversely of the strip away from the centreline to provide a flange receiving channel along each side wall of the strip.

U.S. Pat. No. 3,527,013 by Kruschwitz dated Sept. 8, 1970 discloses a weather or sealing strip for use on the doors and windows of an automobile. This strip includes a channel like portion having inwardly deflected portions adapted to engage with an offset flange on the vehicle to retain the seal strip in position.

British Pat. No. 569,954 by Smye dated Sept. 7, 1943 relates to a guide strip for automobile windows. This strip comprises a channel formed in a resilient flexible material. The side walls of the channel have beads extending therealong which abut against the surface of a glass panel slidably received in the channel to prevent the entry of water into the channel.

U.S. Pat. No. 1,842,586 by Davidson dated Jan. 26, 1932 relates to a channelled strip material for slidably guiding window panels. This material comprises a channel having rib like projections at the free longitudinal edge of each side wall thereof. These rib like projections are intended to deflect to allow panels of different thicknesses to be inserted into the channel whilst cunctioning to retain the panel centrally of the channel.

French Pat. No. 1,252,603 to Marantier dated Feb. 12, 1955 discloses a glazing connector for use in connected glazing panels in a resilient weather manner. The device of this patent comprises first and second walls each having a sawtooth configuration and connected to each other along one longitudinal edge by a resilient hinge like element and having a flexibly resilient web extending along each wall intermediate the hinge element and the respective wall. This element is adapted to be located at the junction between longitudinal edges of adjacent panels with the walls of the channel located between the panels and the flexibly resilient webs lying along the adjacent planar surface along each respective panel. A sawtooth wedge strip of a similar resilient material is then urged between the walls to force the walls downwardly into resilient relationship to the panels to fill the space therebetween and lock with the sawteeth of the walls to prevent removal therefrom. This wedge is provided with laterally extended webs which are disposed at the opposite planar surfaces of the respective panels to form together with adjacent web of the channel like structure a pair or laterally extending channels between which the panel is located.

THE PRINCIPLES OF THE INVENTION

This invention is for use in the construction industry where weather sealing applications are required in conjunction with rigded construction elements. Essentially the invention provides a continuous reglet strip which may be embedded in a concrete wall approximate a junction in the structure being assembled to enable a weatherproofing strip to be inserted therein for supporting relationship in over lying relationship to the junction in the structure. A wedge element inserted into the reglet retains the weatherproofing strip therein to prevent its removal under the influences of adverse conditions. To enable the reglet to be used in this fashion it must therefore be formed in a substantially rigded material simply because substantial loads will be applied thereto during the casting of the wall or structure within which the reglet is to be embedded. Thus devices of substantial resilient glazing such as for example, the glazing devices discussed above are totally unsuitable for use in this particular application.

The system according to the present invention provides a number of forms of the reglet which can be used in different forms of building construction. One form of the reglet is intended to be positioned between brick in a brick construction and secured therein by the mortar which bounds the bricks together with the structure. This reglet however may also be affixed in an exposed condition on a vertical or horizontal portion of the wall according to the requirements of the user. It is however essential that the reglet regardless in the manner in which it is intended to be used be formed in a material which is capable of continuous extrusion to achieve economy in production and yet has sufficient strength to with stand the deflection force which will be applied thereto during use.

Although the invention provides a number of forms of the reglet each form of the reglet have features which are substantially common to all forms of the reglet. Likewise related components which are provided to complete the system may also be formed in a number of different configurations but necessarily have features which are common to all other configurations.

The present invention provides a complete reglet system to enable the construction to weatherproof most parts of a building which are prone to intrusion of the elements.

In the prior art one form of reglet is provided with a membrane which extends along the open edge of the reglet channel so that during embankment grout will not enter the reglet channel. Once the form work is removed this membrane is then torn away from the reglet. The cost to produce a reglet of this type however can be relatively high because the extrusion die is extremely complicated. Additionally a reglet constructed in this manner is somewhat limited in its configuration thus in this respect the present invention constitutes and proves all what has gone before.

Another important feature of the invention resides in the construction of the reglet in such a way that at any time after the building has been completed the reglet wedge may be relatively easily removed to permit the flashing to be rotated within the reglet to permanent access for maintenance purposes to the area protected by the flashing. Once maintenance has been carried out the reglet may then be rotated back into its original position and the wedge replaced. To once again effect adequate sealing and protection of the area covered by the flashing.

The various form of the reglet according to the present invention enable the use of the weatherproofing system of the invention in a wider variety of installations whether those installations be full brick, part brick, timber stucco or cast concrete construction without the need for special adaptation.

It is an object of the present invention to provide an improved weatherproofing system for use in the construction industry.

It is another object of this invention to provide an improved reglet for use in the construction industry in conjunction with an improved flashing element which enables maintenance on the building to which the system is applied to be readily carried out.

In one general form the invention resides in a weatherproofing system for use in the construction industry comprising a reglet having first and second wall means of substantially equal length and width, web means connecting said wall means along adjacent longitudinal edges to form an elongate channel like structure of indefinite length; one of said wall means comprising a substantially elongate planar portion connected along one longitudinal edge to said web means and having a width substantially smaller than the overall width of one said wall means, longitudinal flange means connected along one longitudinal edge to the other longitudinal edge of said planar portion, said flange means extending inwardly of said channel like structure to provide an abutment having a surface facing said web means; a second flange portion having a one longitudinal edge connected to said abutment, a second longitudinal edge defining the free longitudinal edge of said one wall means and a surface portion substantially parallel to the other of said wall means, a plurality of ratchet like element extending along said surface portion to provide a series of closure adjacent abutment surfaces; the spacing between said planar portion and the other space wall means being substantially greater than the spacing between said surface portion and the other said wall means and the depth of said like element being substantially less than the depth of the first spaced abutment face.

BRIEF DESCRIPTION OF THE DRAWINGS

Notwithstanding any other forms which may fall within its scope the invention will hereinbefore be described by way of example, only with reference to the accompanying drawings of which.

DESCRIPTION OF THE PREFERRED EMBODIMENTS OF THE INVENTION

Figure 1:
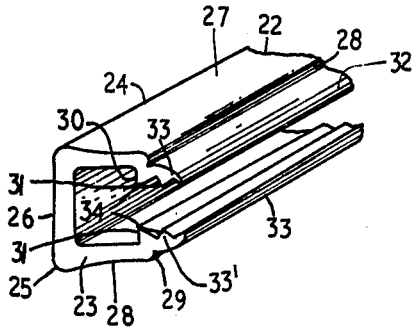
FIG. 1 is a perspective illustration of a portion of one form of reglet according to the present invention.

It is the basic intention of this invention to provide a reglet system for use in weatherproofing buildings which may be used in substantially every mode of installation required by the constructor. The reglet of FIG. 1 is intended to be surface mounted to provide a means of protecting a building connection a part from the elements and a means of protecting that area against impacts applied thereto by trolleys, vehicles and the like. Essentially this embodiment of the invention comprises transversely spaced elongate walls 22 and 23 respectively which are connected together along adjacent longitudinal edges 24, 25 respectively by a web 26 to form an elongate channel like structure which is intended to be mounted on the vertical surface of a wall of a building relative to a part of the building to be protected. The reglet is mounted by placing the rear face 26 against the wall and driving a fixing nail through the web 26 into the wall.

The free longitudinal edge of each wall 22, 23 has an offset portion 28', 29 respectively. Each portion 28', 29 is offset towards the centreline of the reglet to provide abutment faces 30, 31 which face towards the web 26 to provide a primary locking means. Connected to the offset portions 28' and 29 are primary wall sections 32, 33 respectively. These primary wall sections 32, 33 respectively each have at least one longitudinal extending rib 33' which are shaped to provide a secondary abutment facing towards the web 26 to define a secondary locking means. The primary walls 32, 33 should be so formed that they are disposed in planes which are parallel to each other and parallel to the planes opening the side walls 22, 23 so that the primary and secondary locking means may be engaged by primary and secondary locking means on an insert adapted to be received therein.

Figure 2:
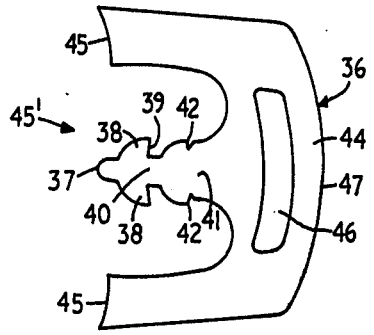
FIG. 2 is an end view of one form of a reglet wedge provided with a cushion element for use in conjunction with the reglet of FIG. 1.
Figure 6:
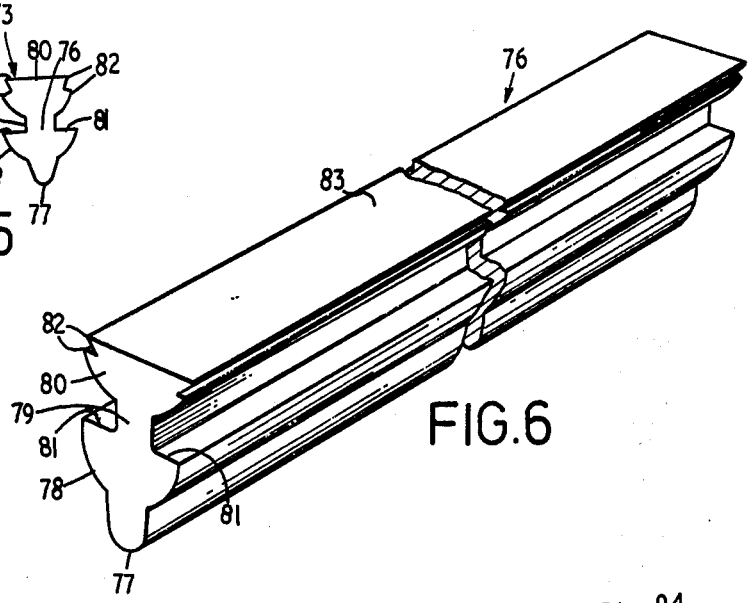
FIG. 6 is a perspective view of the reglet wedge of FIG. 5.

The insert for use in conjunction with the reglet of FIG. 1 may be the cushion wedge 36 of FIG. 2 or the water stop wedge 76 of FIG. 6 depending of course upon the location of the reglet of FIG. 1 relative to the parts of the building to which it is affixed. The cushion wedge 36 of FIG. 2 comprises a body 44 which is a substantially W shaped element. This W shaped element comprises a pair of legs 45 which have a length equal to or slightly greater than the total depth of the reglet. While the centre leg 45' comprises a nose piece 37 having flared portions 38 which are connected by a neck portion 40 to a secondary flared portion 41 which is provided with a pair of latching surfaces 42.

Once the reglet has been fastened to the wall the cushion wedge 36 of FIG. 2 may be offered to the reglet with the nose portion 37 entered into the mouth of the reglet defined by the secondary wall portions 32 and 33. Pressure is then applied to the front surface 47 of the wedge 36 to force the centre leg 45' into the channel of the reglet until abutment surfaces 39 on the rear most portion of the flared parts 38 pass over a terminal edge 34 of the secondary walls 32, 33 to latch behind abutment faces 30, 31. Additional pressure then applied to the wedge 36 will then cause the wedge 36, which is formed in a flexibly resilient material which preferably has a durometer reading of 70, to compress in the region of the nose portion 37 until the latching surfaces 42 lock behind the secondary locking element. At this point the ends of the legs 45 will be engaged against the surface to which the reglet is attached to provide a cushion strip adapted to absorb the impact. The impact may be more easily absorbed by the wedge 36 if an air pocket 46 is provided in the body 44 thereof.

The reglet of FIG. 1 and the wedge 36 of FIG. 2 may be used in conjunction with a soft metal flashing element to provide protection for a building connection part and a means whereby impacts applied by vehicles and the like may be absorbed without damage to the building or the flashing. This flashing should be shaped so that a major portion thereof lies against the wall of the building and has a leg which extends laterally from the building in adjacent relationship to the external surface 28 of wall 23 or surface 27 of wall 22 and a return bent portion which extends into the mouth of the reglet between the secondary walls 32, 33 so that it may be locked in position by the cushion wedge 36.

Alternatively the flashing element may be, where the wall area is not likely to be subjected to impact, locked in position by the wedge 76 of FIG. 6. This wedge is somewhat similar in profile shape to the cushion wedge 36 of FIG. 2 and comprise a nose portion 77 having a flared portion 78 providing abutment surfaces 81 which are connected to a rear most portion 80 by a leg 79. The rear most portion 80 is provided with latching surfaces 82. This wedge is inserted into the reglet in the same manner as the wedge 36 of FIG. 2 but once the abutment surfaces 81 and the latching elements 82 are locked with the abutment surfaces 30 and the latching elements 33' respectively of the wedge of FIG. 1. The rear surface 83 of the reglet seals off the open mouth of the reglet to prevent the entry of water into the reglet.

Figure 5:
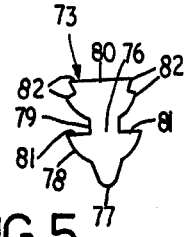
FIG. 5 is an end view of another form of a reglet wedge according to the present invention.

It is quite important that the abutment surface 30, 31 of the reglet of FIG. 1 be substantially longer than the latching surfaces provided by the ribs 33'. On the primary wall sections 32, 33 likewise the wedge of FIG. 2 and the wedge of FIG. 6 as shown in FIG. 5 should have a longer abutment surface 81 than the latching surfaces provided by the ribs 82 to ensure that the wedges 73, 76 and 45' of FIGS. 2, 5 and 6 securely latch in the mouth of the reglet channel. It will thus be seen that if the material from which the wedge is made is not sufficiently plastic to enable distortion of the flared portions 38 and 78 difficulty will be experienced in inserting the wedge into the reglet channel. Because the reglet channel must necessarily be formed in a substantially ridged material preferably this material is a thermoplastic such as for example a polycarbonator.

Figure 3:
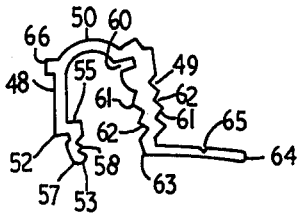
FIG. 3 is an end view of another form of reglet according to the present invention.
Figure 4:
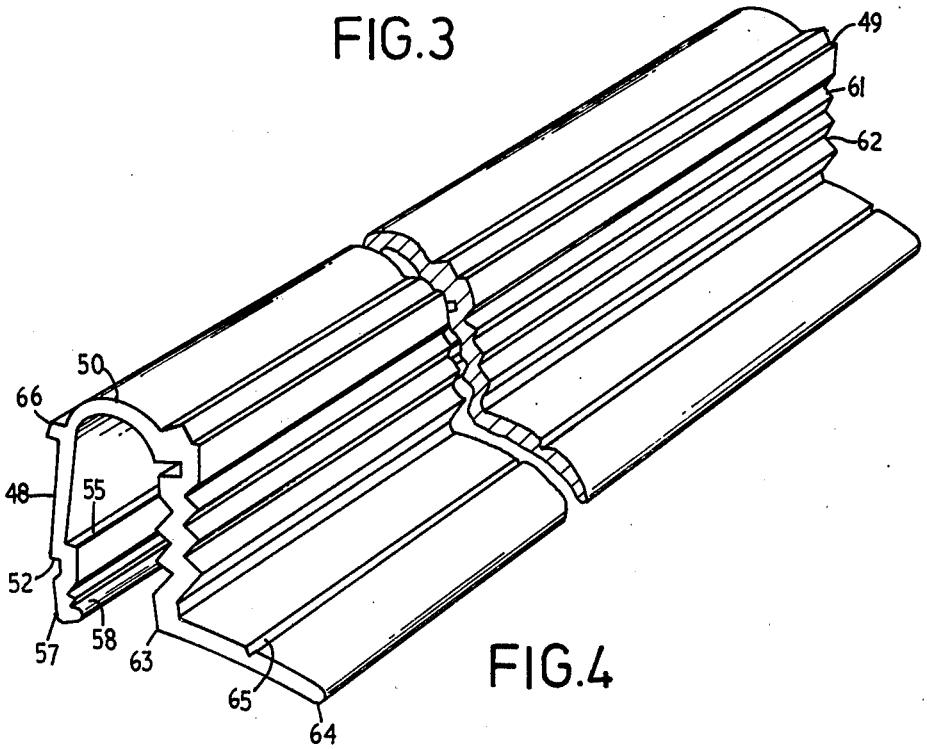
FIG. 4 is a perspective view of the reglet of FIG. 3.

The reglet of FIGS. 3 and 4 differs somewhat from the reglet of FIG. 1. In this embodiment the reglet comprises a planar wall 48 disposed in transversely spaced relationship to the second wall 49 which preferably has a series of ridges and grooves 61 and 62 respectively. Thus walls 48 and 49 are connected along adjacent longitudinal edges by an arcuate web 50 to form a channel like structure. The free longitudinal edge 52 of wall 48 has a flange 55 which extends inwardly of the reglet to provide an abutment face similar to the abutment face 31 of the reglet of FIG. 1. This abutment face has a primary wall section 57 connected thereto which extends in the general direction of wall 48 to terminate at a free longitudinal edge 53 and has a series of latching elements 58 extending therealong on the surface facing the wall 49, while the free longitudinal edge 63 of the wall 49 has a flange 64 connected thereto which extends laterally away from the wall 49 to provide a means for mounting the reglet during installation. This flange 64 has a notch 65 extending therealong at a location intermediate the longitudinal edges thereof through which fixing nails may be driven.

The embodiment of FIGS. 3 and 4 is intended to be embedded in a concrete wall during the casting thereof and is therefore provided with a key flange 66 which functions to key with the concrete to prevent the reglet from working out from the concrete. The flange 64 functions only to enable the reglet to be mounted on the form work panel during construction of the building and serves no precise function thereafter.

Figure 11:
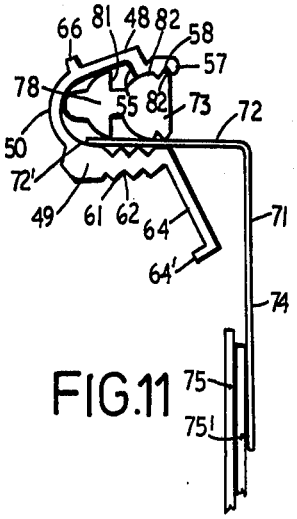
FIG. 11 is an end view of the reglet of FIG. 7 showing one form of flashing located therein by the wedge of FIG. 5.

The reglet of FIGS. 3 and 4 may be used in conjunction with a variety of different forms of flashing. FIG. 11 shows one type of flashing 71 which comprises an elongate element formed in a suitable flexible metal or plastic material having an L shaped configuration. One leg 72 of the element is inserted into the reglet with the free terminal edge 72' located approximate the connection between the wall 49 and the web 50. A wedge 73 is then entered into the reglet until the surfaces 82 latch in the latching elements 58 to retain the wedge in position with the flared portion 78 inwardly of the primary wall 57 so that the faces 81 are behind the latching face 55 and compressibly located between the wall 48 and the upper most surface of the leg 72 to force the leg 72 against the inner surface of the wall 49 and retain the flashing element 71 in position. The other leg 74 of the element 71 extends downwardly over flashing element 75 and 75' to prevent intrusion of water between those elements. It is preferable that the angle between the leg 72 and the leg 74 be less than 90° so that the leg 74 will be continuously urged against the flashing elements 75 and 75'.

If maintenance is required on the building in the area protected by the flashing 75, 75' it is only necessary for the wedge 73 to be removed to enable the flashing 71 to be simply removed while the necessary maintenance is carried out on the portion of the building protected thereby. Removal of the wedge 73 may be achieved by using a sharp tool to lift one end thereof so that it may be grasped and pulled laterally relative the reglet to disengage surfaces 82 from the surfaces 58. Once the maintenance on the building has been carried out the flashing element 75 and 75' may be replaced and the flashing 71 refitted as described above.

Figure 13:
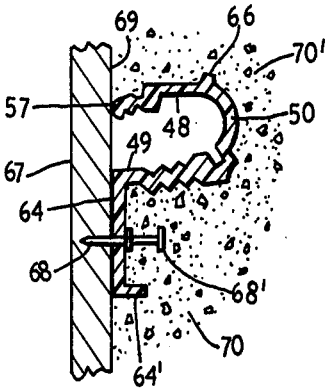
FIG. 13 is a cross sectional illustration of a portion of a cast concrete wall illustrating the method of installing the reglet of FIG. 7.

It is desirable that the reglet according to the invention be produced in 10 foot lengths. Such lengths being the most convenient lengths. Thus in use the form work assembly in a construction project is erected and marked to determine the position in which the reglet is to be installed. A length of reglet is then secured to the form work panel 67, FIG. 13 by means of a nail or like fastener 68 driven through the flange 64 into the panel 67. These nails 68 should be inserted at approximately 1 foot intervals along the length of the flange 64 to ensure that the reglet is adequate secured. It is of course preferable that the flange 64 extend angular away from the wall 49 as illustrated in FIG. 11 so that as the reglet is nailed to the form work panel the free terminal edge 57 of the reglet is urged against the inner surface 69 of the form work panel so that the grouting 70' of the wall 70 cannot pass between the terminal edge 57 and the surface 69 to enter the reglet. Once the grouting 70' has cured sufficiently to provide the wall 70 with a self supporting characteristics the form work panels 67 may be stripped therefrom. If ordinary nails are used to secure the reglet to the form work panel the flange 64 and possibly the wall 49 of the reglet may be damaged as the panel is stripped. For this reason it is desirable that the nail 68 be a double headed nail. The head portion 68' thereof being embedded in the wall 70 to enable the panel 67 to be stripped without damaging the reglet.

Figure 14:
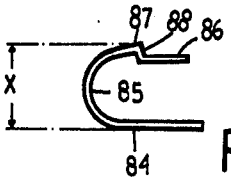
FIG. 14 is an end view of a reglet connector piece according to the present invention.

In some cases the length of a wall being formed may be greater than 10 feet. Thus more than one length of reglet may be installed at any time. Where more than one length of reglet is installed at a time difficulty may be experienced in aligning the reglet ends and sealing connection between the ends to prevent intrusion of grouting. This problem is overcome in the present invention by the provision of a connector. This connector illustrated in FIG. 14 comprises an extruded element having a cross sectional profile complementary to the internal profile of the reglet. The connector comprises a first leg 84 connected by an arcuate portion 85 to a second leg 87 which in turn is connected by a web 88 to a secondary leg portion 86. The leg portion 86 is offset inwardly of the connector so that web 88 provides a surface extending outwardly thereof. Dimension X of the connector should be fractionally greater or equal to the equivalent dimension between the walls 48 and 49 of the reglet of FIGS. 3, 11 and 13 of the connector should be formed in a suitable flexible thermoplastic material so that it may be entered into the reglet with the arcuate portion 85 against the web 50 so that the surface provided by the web 88 will latch behind the abutment surface 55. The legs 87 and 84 and primary leg portion 86 will then be compressibly urged against the corresponding surfaces externally of the reglet to enable adjacent reglets to be easily aligned and provide a seal against intrusion of grouting into the reglet through the spacing between adjacent ends thereof.

The flashing or protective means intended to be used in conjunction with the reglets of this invention may take a wide variety of forms including for example, plastic sheeting, butyle sheeting, synthetic rubber sheeting, preformed aluminium sections, preformed zinc or galvanised sections and copper sheeting. The gauge of the flashing may also vary according to the requirements of the user. The flashing element illustrated in FIG. 12 comprises a preformed elongate metal section 89 comprising a first leg 89' having a first terminal edge 93 and an inner surface 89''. The first leg 89' of the section 89 is connected to a second leg 90 which has an arcuately curved portion 91 and a second terminal edge 92. The first leg 89' and the second leg 90 should be set so that the angle between them is slightly less than 90° to ensure that the inner surface 89'' is urged against the portion to be protected to prevent intrusion of the elements beneath the section 89.

The second leg 90 and its arcuately curved portion 91 are formed so that when the curved portion 91 is received in the reglet the second terminal edge 92 is disposed inwardly from the abutment face 55. Thus, when the wedge 73 is positioned in the reglet with its latching surfaces 82 co-operatively engaged with the elements 58. The nose portion 77 is slightly compressed to urge the outer surface 90' of the arcuate portion 91 against the arcuate portion 50 of the reglet while the flared portion 78 functions to urge the terminal edge 92 laterally away from the leg 90 against the inner surface of the leg 48 to retain the element 89 securely in position. The rear face 83 of the wedge 73 will provide a water stop for the flashing and reglet assembly.

Figure 12:
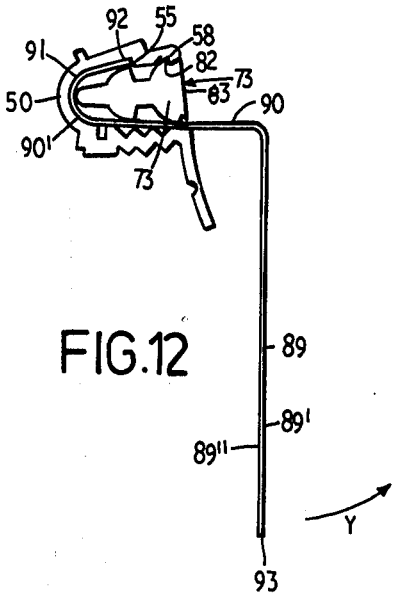
FIG. 12 is an end view of the reglet of FIG. 3 showing another form of flashing received therein and secured by the wedge of FIG. 5.

With the flashing section 89 of FIG. 12 maintenance on the protective portion of the building may be simply carried out by removing the wedge 73 as hereinbefore described and pivoting the first terminal edge 93 in the direction of arrow Y. This action will move leg 90 in the same direction causing the section 89 to attempt to come outwardly of the reglet until terminal edge 92 abuts the abutment surface 55. Whereupon further movement in the direction of arrow Y will cause the section to pivot about the terminal edge 92 until the section 89 is in a position enabling the necessary maintenance to be carried out. When the maintenance is complete the flashing section 89 may be restored to its original position by moving terminal edge 93 in the opposite direction until the leg 90 is again bearing on wall 49. Whereupon the wedge 73 is re-inserted to restore the original condition.

Because the wedge 73 is partially under compression to retain the flashing element it is substantially important for the flashing element to move in any direction relative the reglet. For this reason the reglet system according to the present invention may be used in the inverted or inclined mode on the building. A function which cannot be performed by most of the prior art reglet systems without the need for additional securing means. Similarly because the system according of the present invention requires no mastic to be inserted into the reglet to retain the flashing maintenance on the protected areas of the building is more easily achieved. It would of course be appreciated by those skilled in the art with the provision of a slot 60 (FIG. 7) to accommodate a bent lip flashing (not shown) will induce a point of weakness intermediate the connection between wall 49 and curved portion 50 of the reglet. For this reason the area in the region of the connection 49'' between the wall 49 and curved portion 50 is a greater cross sectional dimension to provide a strengthening zone 49''. The connection 64' along the longitudinal edge 63 of wall 49 should be formed in such a way that as the reglet is nailed to the form work panel as previously described herein the leg 49 and the flange 64 will move angularly relative to each other without placing undue stress on the portions of the reglet to result in fracture or inadvertent damage to the reglet. Additionally it is preferred that the free terminal edge 64' of a flange 64 be provided with a bent portion which will key into the grouting of the wall during casting thereof to prevent the flange 64 from springing angularly away from the wall, once the form work has been removed, to prevent the flashing from locating correctly relative to the area to be protected.

In some circumstances more than one length of the wedge 73 will be required in one wall section. Thus eventhough the connection between the abutting ends of adjacent lengths of web may be as good as possibly can be achieved. It is still possible for moisture to enter the reglet therebetween. For this reason it is desirable that during installation of the flashing overlapping edges of the flashing be positioned at a location away from the connection between adjacent lengths of reglet and the abutting edges of adjacent lengths of reglet edge be positioned at a location remote from the overlapping flashing and the connections between the reglets so that the space between adjacent ends of the lengths of wedge may be filled with a suitable sealing compound.

With known types of flashing systems where a section of a wall is to be completed at a later date than an adjacent section it is necessary to extend the reglet beyond the end former of the form work thus necessitating the form work assembly to cut the form work panels to the shape of the reglet to enable the reglet to extend beyond the section being casted. This action not only increases the cost of the form work assembly but exposes the end work of the reglet to damage through impact and other means. With the present invention however this problem is overcome by terminating the reglet at the appropriate place within the form work assembly and inserting a short length of wedge into the reglet and sealing it in position with a small quantity of a suitable sealing compound. Thus obviating the need for form work panels to be cut in the reglet end to be exposed to undesirable damage.

Figure 16:
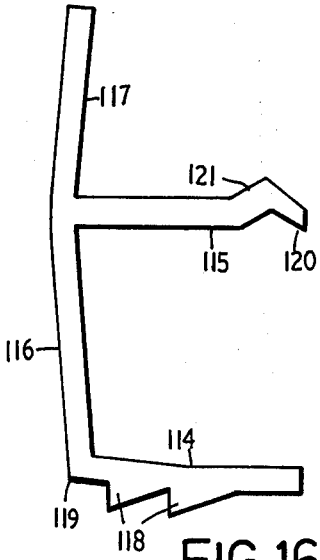
FIG. 16 is an end elevation of a reglet grout shield according to the present invention.

During the assembly to form work panel of a construction site it is often found that the panels themselves are warped, twisted or otherwise damaged to the extent that the terminal edges of the reglet cannot seal properly there against so that grouting enters the reglet during the pouring of the concrete. In the system according to the present invention a grout shield is provided which obviates the necessity for a sealing relationship between the edges of the channel and the form work panel. One form of reglet grout shield is illustrated in FIG. 16 and comprises first and second legs 114 and 115 respectively. These legs are connected along adjacent longitudinal edges by a web 116. The legs 114 and 115 are set so that they diverge away from the web 116 so that they will be urged towards each other when they are inserted through the mouth of the reglet. The leg 115 has a kink or offset portion 120 providing a latching part 121 which will engage with one of the grooves 62 in the reglet of FIG. 3 while the other leg 114 is provided with at least one ridge 118 which will engage with the elements 58 on the primary wall 53 of the reglet of FIG. 3. These ribs 118 should be spaced slightly inwardly from the terminal edge 119 so that the terminal edge 119 will lie in the plane of the terminal edges 67 and 63 of the reglet. The wall 116 is provided with a skirt 117 which extends beyond the wall 115 to overlie the flange 64 so that as the reglet is nailed to the form work panel the nails will pass through the skirt 117 to retain the reglet and the seal in position irrespective of any distortion which may result in the reglet. The leg 115 is fractionally longer than the leg 114 so that the skirt 117 and the web 116 forms an obtuse angle to ensure that sealing is properly achieved.

Figure 21:
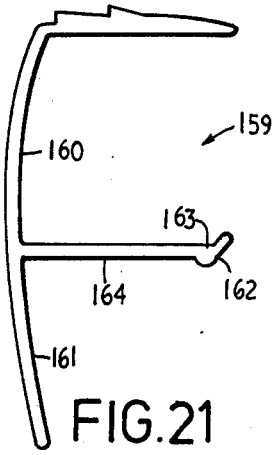
FIG. 21 is an end elevation of a modified form of the grout shield of FIG. 16.

The grout shield of FIG. 21 has one or two slight differences to the grout shield of FIG. 16. In this respect the web 160 which connects the walls form a curved section with the skirt 161. Thus making the manufacturer of the extrusion die by which it is produced simplar than the die required for the shield of FIG. 16. This grout shield 159 has an offset portion 163 at the end of the lower leg 161 and a bolus section 162 which replaces the peak section 121 of FIG. 16.

Figure 24:
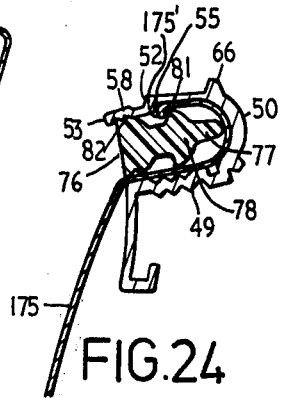

As many be seen from FIG. 24 where a flexible flashing or protective element 175 is to be used in conjunction with the reglet the element 175 is folded back on itself and inserted into the reglet with the free terminal edge thereof in board of the abutment surface 55 so that when the wedge 76 is inserted into the reglet the flared portion 78 urges the terminal edge 175' against the wall 48 while the nose portion 77 urges the folded section against the arcuately curved web 50 thus the element is securely retained within the reglet.

Figure 17:
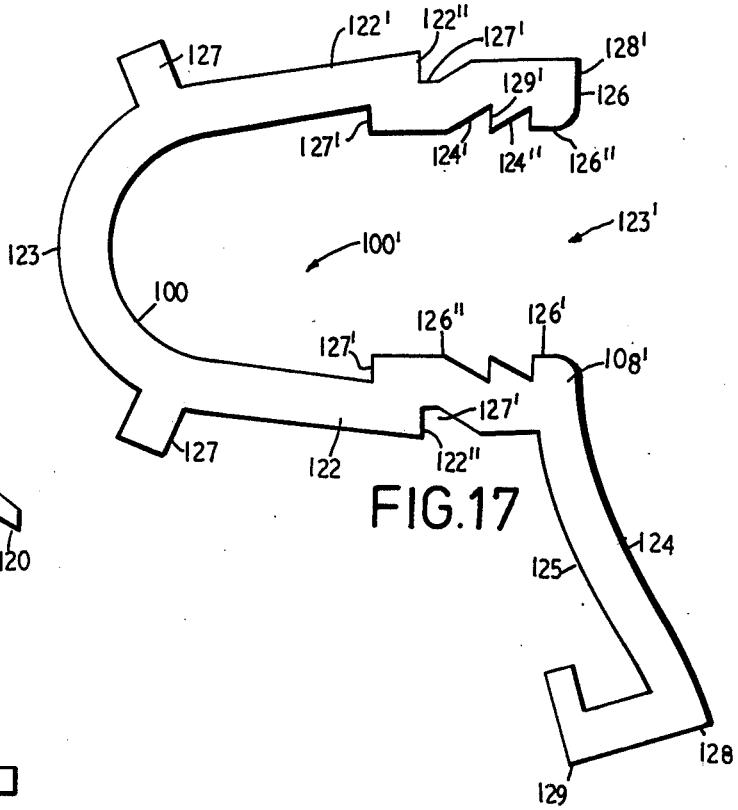
FIG. 17 is an end view of a modified form of the reglet of FIG. 15.

FIG. 17 illustrates in modified form of the reglet of FIG. 3. This form of the reglet comprises a U shaped section 100 the legs 122 and 122' of which diverge from the arcuate portion 123 towards the mouth 123' to the reglet. Attached to the free ends 122" of each leg 122 and 122' are primary wall sections 126 and 126'. These primary wall sections are offset inwardly of the ends 122" of the U shaped section 100 and are disposed in parallel relationship to each other to provide the reglet with a channel mouth 123' which is narrower than the remainder of the channel 100' of the reglet. The in board portions 127' of each primary wall section 126, 126' define abutment surfaces behind which the free terminal edge of a flashing element will be located. The inner surfaces 126" of each primary wall section are provided with grooves and ridges 124' and 124" respectively which are shaped to provide abutment surfaces 129' which face towards the arcuate portion 123 of the channel 100' which are adapted to receive the latching surfaces 82 of the wedge 76 of FIG. 6. The free terminal edge 108' of the leg 122 is provided with a flange 125 which extends angularly away from the leg 122 to provide the means whereby the reglet may be attached to a form work panel in a manner similar to that described in connection with FIG. 13 hereof. The free terminal edge 128 of the flange 125 is provided with a key 129 which retains the flange 125 in contiguous relationship to the surface of the wall once the form work panels have been stripped. The outer most surface 124 of the flange 125 is curved to provide the flange 125 with a spring like resiliency so that once it is nailed to the form work panel the end 128' of the leg 122' will be biased into sealing relationship with the form work panel to prevent the entry of grout in through the mouth 123' of the channel 100'. Where required however the grout shield of FIG. 16 or the grout shield of 159 of FIG. 21 may be utilized to prevent the intrusion of grout through the mouth 123' when adequate sealing cannot be achieved.

At the junction each leg 122 and 122' and the arcuate portion of the channel there is provided a lug 127 which functions to key the reglet into the grout to prevent movement thereof laterally relative to the wall. Further keys are provided by undercut portions 127' at the junction between the primary walls 126 and 126' and their respective legs 122 and 122'.

Each leg and its associated primary portion is identical in configuration with the other leg and its primary portion so that the reglet may be used in the horizontal or inverted position according to the nature of the location to which it is to be embedded regardless of the direction in which the flashing element will ultimately extend therefrom.

Figure 15:
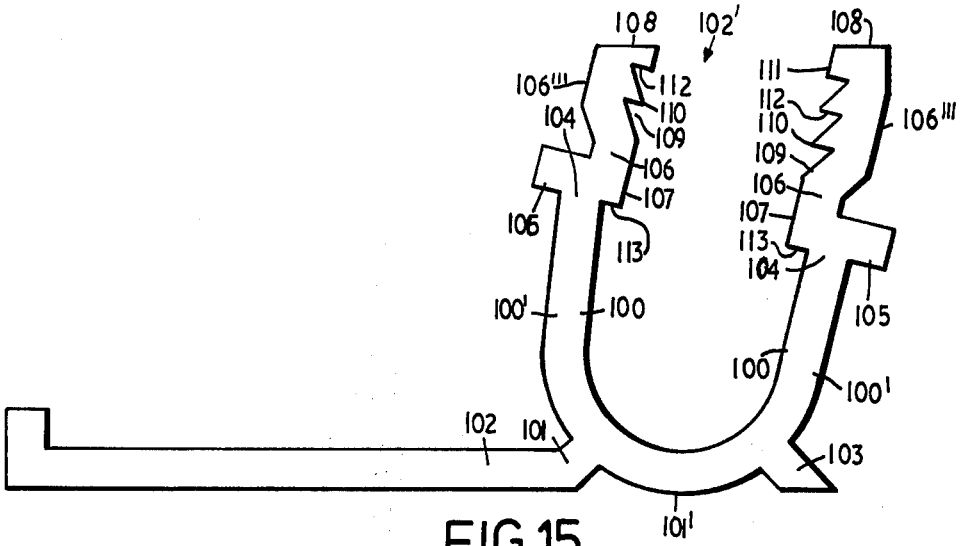
FIG. 15 is an end elevation of another form of reglet according to the present invention.

The reglet of FIG. 15 is a surface mounted reglet having a construction somewhat similar to the reglet of FIG. 17. Although this form of the reglet is intended primarily to be surface mounted in an exposed condition it may also be mounted on the surface of a wall which is ultimately to be treated with stucco or like type of surface coating. This form of the reglet comprises a flange or bracket portion 102 which is adapted to be nailed or screwed to the wall surface. The flange 102 is connected at 101 to a U shaped portion 101'. The legs 100 of which diverge slightly towards the mouth 102' of the reglet. A lug 103 is provided on the external surface 100' of the U shaped channel 101' in opposite relationship to the connection 101 to provide a support for the channel.

The axis of the channel mouth 102' is preferably disposed at an angle 12.5° to the plane containing the flange 102. While the connecting part 101 and the lug 103 are disposed at 90° to each other to achieve optimum support of the reglet relative to the wall on which it is mounted and to enable adequate key of the reglet with the surface coating which might be applied to the wall surface. The leg 100" is fractionally longer than the leg 100'. While each terminal end 104 of the leg 100 are provided with longitudinally extending flanges 105 and 106 which together with their respective legs 100' and 100" form in a cross section T shaped structure. The inner most ends 107 of which extend inwardly of the channel 102' for some distance to provide a pair of abutment surfaces 113 behind which the free terminal edge of a flashing element may be located. Each flange 105, 106 has a primary leg portion 106' and 106" respectively which extend from the inner end 107 of the respective flanges outwardly of the channel 101' towards the mouth 102'. The spacing between these primary legs being substantially smaller than the spacing between the legs 100' to provide the channel 101' with a narrow mouth. Primary leg 106" is shorter than the primary leg 106' so that the free terminal edges 108 and 108' thereof are contained within a plane which extends parallel to the plane of the flange 102.

The primary legs 106, 106" are provided with ridges and grooves 109, 110 which are shaped to provide abutment surfaces which face inwardly of the channel mouth 102'. These abutment surfaces are arranged to provide primary locking means to receive elements 82 of the wedge of FIG. 6 and are so formed that the apexes formed thereby are contained within the plane of the surface 111. It is preferred that the external surface 106' of each primary leg 106" be relieved to avoid dissent during extrusion and to provide the primary legs with a degree of resiliency to enable the flashing and the wedge to be inserted therein with as few problems as possible.

Figure 7:
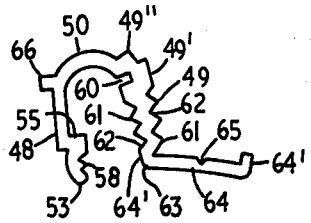
FIG. 7 is a modified form of the reglet of FIG. 4.
Figure 8:
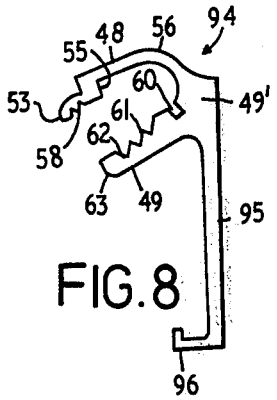
FIG. 8 is another variant form of the reglet according to the present invention.
Figure 9:
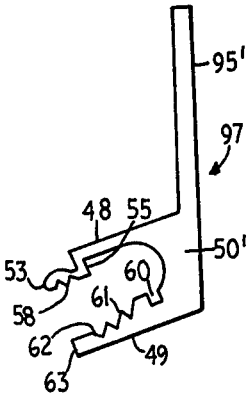
FIG. 9 is yet another form of reglet according to the invention.
Figure 10:
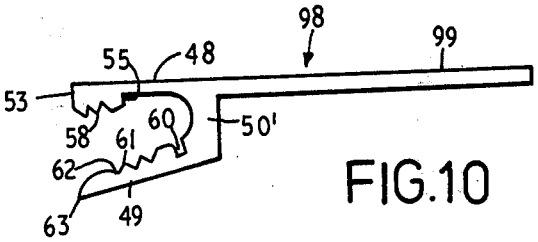
FIG. 10 is a variation of the reglet of FIG. 9.

The reglets of FIGS. 8, 9 and 10 are similar in many respects to the reglet of FIG. 7. Accordingly like labels are given to like parts. The reglet 94 of FIG. 8 is a surface mounting reglet having a channel element similar to that of FIG. 7 but is provided with a bracket portion 95 which is connected to the reglet channel at the strengthening zone 49'. In this form of the reglet the flange 64 is omitted and the wall 49 has a planar external surface 49"' which extends parallel to the axis of the reglet channel and is set at an angle of about 45° to the bracket 95. The free terminal edge 96 of the bracket 95 is provided with a return bent portion to strengthen the bracket against twisting during fixing of the reglet.

The reglet 97 of FIG. 9 is similar in some respects to the reglet 94 of FIG. 8 except that the mounting 95' is connected to an enlarger portion 50' at the rear of the arcuately curved portion 50 and extend at an obtuse angle to the wall 48. This form of the reglet is intended to be mounted with the bracket 95' extending vertically above the area to be protected.

The reglet 98 of FIG. 10 is provided with a bracket 49 which extends rearwardly of the reglet in the plane in which the wall 48 is contained. This form of the reglet is intended to be mounted with the bracket 99 extending horizontally across the top of a wall part.

Figure 18:
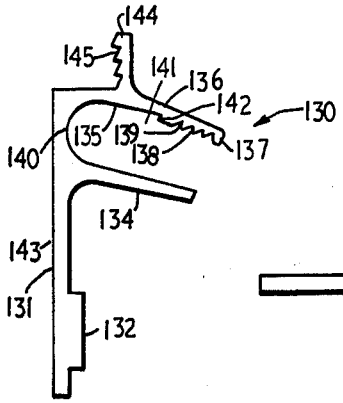
FIG. 18 is a modified form of the reglet of FIG. 8.

The reglet of FIG. 18 comprises a mounting bracket 131 having a thickened portion 132 to provide strengthening and through which fixing nails or screws are extended to fasten the reglet to a vertically extending wall surface with the rear face 143 in contacting relationship thereto. The reglet channel 130 comprises a first leg 134 connected to the bracket 131 at an angle of about 60° thereto. The upper most portion 140 of the bracket 131 connects the wall 134 to a second wall 136 which extends in parallel relationship to the walll 134 to form a channel. The outer most longitudinal portion of the wall 136 is provided with a step portion 137 which is formed to provide an abutment surface 142 which faces inwardly of the channel 130. The spacing between the step portion 137 and the wall 134 is smaller than the spacing between the inner portion 135 of the wall 136 and the wall 134 to provide an inner channel portion of greater lateral dimensions than the outer portion 130. The step portion 137 has a series of sawtooth like ridges extending therealong providing a series of abutment surfaces 139 which face inwardly of the channel. Extending upwardly from the wall 136 at a point intermediate the step portion 137 of the connection 140 is a wall portion 144 the rearward surface of which is provided with a series of ridges and grooves. It is preferred that the wall 144 which inclined slightly towards the direction of the rear surface 143 of the mounting bracket 131.

Figure 20:
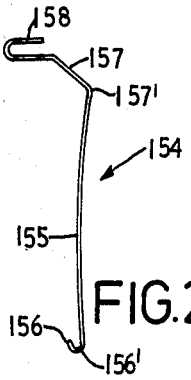
FIG. 20 is an end view of another form of flashing member according to the present invention.

In use the reglet of FIG. 18 is mounted on a wall part of a building relative an area to be protected and secured thereto by fasteners inserted through the portion 132 of the bracket 131. Once the reglet has been adequately secured a suitable sealing compound such as dow corning silastic is inserted in the area between the wall portion 144 and the opposite surface of the wall to which the reglet is affixed. This area should be filled with the material sufficiently to prevent voids and gaps formed therein. Once the silastic material has cured the protection element to be used for example the flashing of FIG. 20 is inserted into the channel of the reglet so that the free terminal edge is in bored of the abutment surface 142 and the wedge 76 of FIG. 6 inserted therein to retain the flashing and seal the reglet channel 130.

In some cases more than one length of the reglet of FIG. 18 may be required along a wall part of the building thus it will be necessary to seal the gap between the adjacent reglet ends. This may be achieved once the flashing and wedge has been fitted by applying a quantity of dow corning silastic thereto so that once the silastic has cured the connection between the reglet ends will be sealed against the intrusion of moisture.

Figure 19:
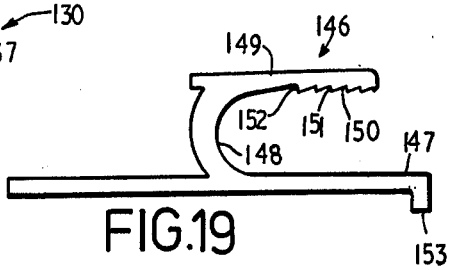
FIG. 19 is an end view of another form of reglet according to the present invention.

The reglet of FIG. 19 is a modified form of the reglet of FIG. 18 and is intended for use in brick construction. This form of the reglet comprises an element 147 having an arcuate wall 148 which connects a second wall 149 to the element 147 to form a channel 146. The wall 149 is provided with a step portion 150 having a series of sawtooth like ridges 151 and providing an abutment surface 152 enabling the flashing and wedge to be used in conjunction therewith as previously described with the reglet of FIG. 18. The planar portion 147 is provided with a flange 153 enabling accurate location of the reglet relative to the building part to which it is being attached.

Primarily this form of the reglet is intended to be inserted between the bricks in a brick wall on the upper surface of the brick wall or in a recess in a brick wall.

FIG. 20 shows a flashing element 154 which is intended for use where the wall part has obstructions necessitating extra extension of the flashing relative to the wall. This form of the flashing 154 comprises a U shaped element 158 one leg of which has an obtuse portion 157 connecting at 157' to the covering portion 155. The terminal edge 154' of which is provided with a curved lip 156. The angle between the portions 157 and 155 should be such that when the flashing is installed the return bent portion 156 is biased against a wall surface of the building to ensure security of the flashing and adequate protection of the area covered thereby.

Figure 22:
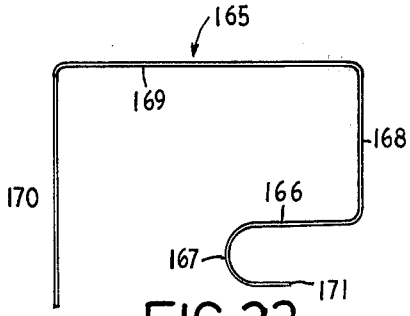
FIG. 22 is an end elevation of a cap flashing element according to the invention.

FIG. 22 shows a cap flashing element 165 comprising which is adapted to be used in conjunction with the reglet of FIG. 17 or the reglet of FIG. 7 when mounted in the inverted position. The flashing 165 comprises a first leg 166 having an arcuately curved portion 167 adapted to be received in the channel of the reglet and a terminal edge 177 intended to be received behind the abutment face of the reglet. The leg 166 of the reglet has a second leg 168 connected thereto which extends laterally therefrom in a direction away from the terminal edge 171. This leg 168 has third and fourth legs 169 and 170 connected serially thereto to provide a U shaped section intended to be located over an exposed upper surface portion of a wall or like part of a building to prevent transfer of moisture or to protect the part of the building against the elements.

Figure 23:
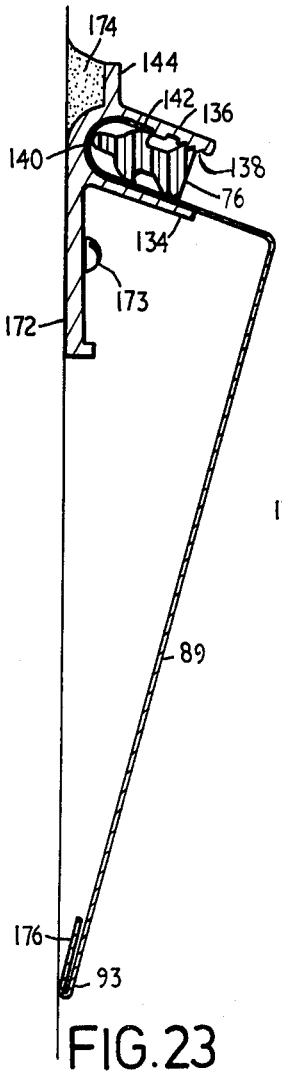
FIG. 23 is an illustration showing the reglet of FIG. 18 installed on a wall.

FIG. 23 shows a variant form of the reglet of FIG. 18 mounted on a wall with a flashing element and wedge fitted thereto. This form of the flashing comprises a leg 172 adapted to be fastened to a wall by screws or nails 173. A first leg 134 extends from the mounting part 172 at an angle of about 60° to provide a bearing point for the leg of the flashing 89. The leg 134 is connected to a second wall 136 by an arcuate portion 140. The walls 136 and 134 are substantially parallel. The flashing 89 and the wedge being retained therein by latching elements 138 with which the latching elements 82 of the wedge 76 of FIG. 6 engage. This form of the reglet is provided with an outstanding wall portion 144 which together with the wall of the building defines an area which is filled with a silastic material 174 as previously described to prevent the intrusion of moisture behind the reglet.

Those skilled in the art will appreciate from a consideration of the system hereinbefore described that the present invention provides the means for protecting substantially any part of a building required to be protected. There are however certain variant forms which although not described herein fall within the spirit and scope of the invention defined in the claims hereof.

What I claim is:

1. In a weatherproofing system for a building, the combination of a reglet comprising a first wall, a second wall and a web connecting said walls along adjacent sides to form an elongate channel adapted to be secured to the wall of a building, at least one of said walls having a first elongate portion connected along one side to said web, a flange extending along the other side of said elongate portion and projecting laterally towards the other one of said walls to provide an abutment surface facing said web and an inner terminal surface facing said other wall, a second elongate portion connected along one side to said flange adjacent said terminal surface and extending outwardly of said channel in a direction substantially parallel to said other wall and having at least one groove extending along the inner surface thereof to provide at least one primary abutment surface facing towards said web, the spacing between said second elongate portion and said other wall being substantially less than the spacing between said first portion and said other wall providing said channel with a narrow mouth; and elongate protective element having a first part for covering the building part to be protected and a second part receivable through said channel mouth; and a flexibly wedge comprising a first elongate part receivable through the channel mouth into the space between said first elongate portion and said other wall, a second elongate part receivable between said second elongate portion and said other wall, and a neck portion connecting said first elongate portion to said second elongate portion, said first wedge part including a flared portion including terminal portion for bearing respectively against said first elongate portion and said second part of said protective element to clamp said second part of said protective element against said other wall, said second elongate wedge part including a flared part having at least one terminal element receivable behind said at least one primary abutment surface to lock said wedge in said channel and at least one terminal portion bearing against said second protective element part and said other wall, and a rear surface portion for closing off the mouth of said channel.

2. A weatherproofing system as in claim 1 including a mounting bracket connected to said reglet for mounting said reglet on a wall.

3. A weatherproofing system as in claim 1, wherein said wedge comprises a nose piece for biasing a protective element part against said web, a portion flaring rearwardly from said nose piece to provide a first terminal portion for urging said second element part against said other wall, a second terminal portion for bearing towards said elongate channel portion, an abutment surface adjacent at least said second terminal portion for latching behind the first said abutment surface, a neck portion connecting said flared portion to a second flared portion having latching surfaces at the terminal edges thereof for latching behind the primary abutment surface.

4. A weatherproofing system according to claim 1, wherein said protective element comprises a flexibly resilient sheet of moisture impervious material having a longitudinal portion received in said channel.

5. A weatherproofing system as in claim 1, wherein said protective element comprises a flashing formed in a metallic material and comprising an elongate element having a cross sectional L shaped configuration, one leg of the L shape defining the first protective element part and the other leg defining the second protective element part.

6. A weatherproofing system as in claim 1, wherein said protective element comprises an elongate metal flashing having a first terminal edge at one side, a second terminal edge at the other side, a first portion intermediate said sides for covering the building part to be protected, a second portion intermediate said first portion and said second side and set at an obtuse angle relative said first portion, a third portion set at an obtuse angle relative said second portion and having an arcuately curved profile terminating at said second terminal edge and adapted to be received in said reglet with said free terminal edge bearing against said first elongate reglet portion behind said abutment surface, said wedge being received in said reglet channel with the first elongate wedge part entered in the arcuate flashing portion to urge said free terminal edge and said second part laterally away from each other to lock said flashing in said reglet.

7. A weatherproofing system according to claim 1 wherein said second protective element part includes an arcuately curved part for being clamped between said first wall, said web, said first elongate channel part and said first elongate wedge part.

8. A weatherproofing system as in claim 7, wherein said protective element comprises an elongate metal flashing having an L shaped cross sectional configuration, one leg of the L shape forming the first protective element part and the other leg forming the second protective element part.

9. A weatherproofing system as in claim 8, wherein the said other leg includes a return bent portion including a third leg extending laterally away from said one leg in parallel relationship to the said other leg and a third leg extending laterally away from said third leg in parallel relationship to said one leg to define a generally U shaped portion for capping a wall.

10. A weatherproofing system as in claim 1, wherein the said other wall of the reglet comprises an elongate element having a meandering cross sectional configuration providing a series of alternate ridges and grooves defining a key for retaining the reglet in a cast concrete wall.

11. A weatherproofing system as in claim 10 including a flange, extending laterally from the free terminal edge of said other wall in a direction away from said channel, for attaching said reglet to a panel of a formwork system for casting concrete building walls.

12. A combination as in claim 11, including a connector for connecting the adjacent ends of aligned reglets during casting of a wall, said connector comprising a first leg, a second leg, and an arcuately curved portion connecting said legs along adjacent longitudinal edges to form a channel shaped structure, one of said legs having a portion offset towards the other wall to provide an abutment surface facing outwardly of said channel, said connector being adapted to be inserted into the open mouths of adjacent reglets in overlapping relationship thereto with said abutment surface latched behind the first said abutment surface of said reglet to align said reglets for fixing to a formwork panel and for sealing the join between said reglets against the intrusion of concrete grout during casting of said wall.

13. A combination as in claim 12 including a grout shield for sealing off the mouth of said reglet during casting of said wall, said grout shield comprising an elongate resilient member having a first wall, a second wall, a web connecting said walls along adjacent longitudinal edges to form a channel receivable through the mouth of said reglet channel to close off the mouth, one of said walls having at least one rib extending along the outer surface thereof adjacent said web for latching behind said primary abutment surface, and the other wall having a latching element extending along the free longitudinal edge and adapted to be received in a complementary latching slot formed in said other wall.

14. A combination as in claim 13 wherein said grout shield includes a skirt extending laterally from said other wall and adapted to overlie the flange of said reglet.

15. In a weatherproofing system for use in the construction industry, a reglet having first and second wall means of substantially equal length and width, web means connecting said walls means along adjacent longitudinal edges to form an elongate channel like structure of indefinite length; one of said wall means comprising a substantially elongate planar portion connected along one longitudinal edge to said web means and having a width substantially smaller than the overall width of one said wall means, longitudinal flange means connected along one longitudinal edge to the other longitudinal edge of said planar portion, said flange means extending inwardly of said channel like structure to provide an abutment having a surface facing said web means; a second flange portion having a one longitudinal edge connected to said abutment, a second longitudinal edge defining the free longitudinal edge of said one wall means and a surface portion substantially parallel to the other of said wall means, a plurality of ratchet like elements extending along said surface portion to provide a series of closure adjacent abutment surfaces; the spacing between said planar portion and the other space wall means being substantially greater than the spacing between said surface portion and the other said wall means and the depth of said ratchet like element being substantially less than the depth of the first spaced abutment face.

16. A reglet comprising first and second elongate wall members arranged and disposed in transversely spaced longitudinal alignment and connected to each other along adjacent longitudinal edges by a web to form a channel shaped structure, the free longitudinal edge of at least one of said wall members having an inwardly stepped portion including a portion perpendicular to the wall defining an abutment facing inwardly of the channel and a plurality of ratchet like elements extending along at least one wall member in the region of the free longitudinal edge thereof.

17. A reglet comprising first and second elongate wall members arranged and disposed in transversely spaced longitudinal alignment and connected to each other along adjacent longitudinal edges by a web to define a channel shaped structure, an inwardly stepped portion extending along the free longitudinal edge of each wall member, each stepped portion including a surface substantially perpendicular to the respective wall member to define an inwardly facing abutment surface adapted to be engaged by complementary abutment surface means on a component receivable in said channel shaped structure, the innermost surface of each said stepped portion having a plurality of ratchet like ridges extending therealong outwardly of said abutment surface adapted to be engaged by complementary means on said component to retain said component therein.

18. In combination the reglet of claim 17 and a cushion wedge comprising an elongated W shaped element, the centre leg of the W shaped element having a front portion and a rear portion, said front portion having outwardly flared abutment faces and said rear portion having outwardly flared ratchet like elements, said centre leg being receivable within said channel in a manner whereby said abutment faces and said ratchet like elements engage with the respective abutment faces and ratchet like elements on said wall member to lock said reglet and said cushion wedge together.

19. A reglet comprising first and second wall members arranged and disposed in transversely space longitudinally aligned relationship and connected along adjacent longitudinal edges by an web to form a substantially U-shaped channel like structure, the free longitudinal edge of the first one of said wall members having an inwardly stepped portion including a surface portion perpendicular to the inner surface of the first wall member defining an inwardly facing abutment surface and a plurality of ridges extending along the inner surface of said portion between said abutment surface and the longitudinal free edge of said portion to define ratchet like engagement means adapted to be engaged by complementary engagement means on said component.

20. A reglet as in claim 19 including a web like member extending along the outer surface of the arcuate web and disposed at an angle to the plane of the outer surface of the said second wall member.

21. A reglet as in claim 19 including a web like member extending along the connection between the arcuate web and the first said wall member.

22. A reglet as in claim 19 including projection means on the outer surface of said reglet defining key means to secure said reglet in cast concrete.

23. A reglet as in claim 22 including a web extending angularly outward from the free longitudinal edge of the second wall member providing a means of securing said reglet to concrete formwork.

24. In combination a reglet as in claim 22 a flashing element comprising an elongate L shaped member having an arcuate portion extending along the free extremity of one leg of the member and adapted to be received in the channel in a manner whereby the free edge of the arcuate portion engages behind the abutment surface; an elongate wedge like element comprising a front portion adapted to be located within the arcuate portion of said flashing, an outwardly flared abutment portion rearwardly of said front portion and adapted to urge the legs of the arcuate portion outwardly, a shank connecting said abutment portion to a rear portion, said rear portion having edge portions adapted to engage with said plurality of ridges and the said one leg of said L shaped member to lock said flashing into engagement with said reglet.

25. In a weatherproofing system for a building, a reglet for casting into a concrete wall comprising a first wall, a second wall, a web connecting said walls along adjacent longitudinal edges to form an elongate channel, first and second primary wall portions disposed in parallel spaced relationship and connected respectively to the inner terminal edge of the first and second walls to provide a narrow channel mouth, the connection between each primary wall portion and its respective channel wall providing an abutment surface facing towards said web and extending laterally relative said primary wall portion, at least one groove extending along each primary wall portion providing primary abutment surfaces facing towards said web and extending laterally relative said primary wall portions, a plurality of elements formed on the external surface of said reglet for keying into the concrete to retain said reglet therein, and a flange extending laterally outwardly from the terminal edge of one primary wall portion for fastening to a formwork panel to support said reglet during forming of the wall, in combination with a flashing having a portion for covering the building part to be protected and a portion receivable through said mouth into said channel, and a wedge having a nose portion receivable in said channel for clamping said flashing against the inner wall surfaces of said channel, a rear portion receivable between said primary wall portions to close off the mouth of said reglet and retaining means engageable with said abutment surfaces to retain said wedge in said channel.

26. In weatherproofing system for a building a reglet comprising first and second wall means of substantially equal length, web means connecting said wall means along adjacent longitudinal edges to form an elongate channel of indefinite length; one of said wall means comprising a substantially elongate planar portion integrally connected along one longitudinal edge to said web means and having a width substantially smaller than the overall width of said one wall means, longitudinal flange means integrally connected along one longitudinal edge to the other longitudinal edge of said planar portion, said flange means extending inwardly of said channel like structure to provide an abutment surface facing said web means; a second flange portion extending from said abutment surface outwardly of said channel and forming with the free longitudinal edge of the other said wall a channel mouth which is narrower than the remainder of said channel, a plurality of ridges extending along said second flange portion intermediate said abutment surface and the free longitudinal edge of said one wall means, said ridges each having a surface forming a secondary abutment surface facing said web means and having a depth less than the depth of said abutment surface; covering means receivable in said reglet for covering a building part to be protected and means receivable in said channel for retaining said covering means.

* * * * *